United States Patent [19]

Rehbogen, Jr. et al.

[11] 4,367,006

[45] Jan. 4, 1983

[54] CONNECTOR FOR FLAT CABLE

[75] Inventors: Andrew J. Rehbogen, Jr., Harrisburg; Robert N. Whiteman, Jr., Middletown, both of Pa.

[73] Assignee: AMP Incorporated, Harrisburg, Pa.

[21] Appl. No.: 214,859

[22] Filed: Dec. 10, 1980

[51] Int. Cl.[3] ..... H01R 9/07

[52] U.S. Cl. ..... 339/176 MF; 339/17 F; 339/258 P

[58] Field of Search ..... 339/17 F, 176 MF, 258 R, 339/258 P, 95 D, 176 MP

[56] References Cited

U.S. PATENT DOCUMENTS

| | | | |
|---|---|---|---|
| 3,392,366 | 7/1968 | Nakazawa | 339/176 MP |
| 3,470,522 | 9/1969 | Lawrence | 339/258 R |
| 3,629,787 | 12/1971 | Wilson | 339/17 F |
| 3,631,381 | 12/1971 | Pittman | 339/176 MP |
| 3,989,336 | 11/1976 | Rizzio | 339/74 R |
| 4,181,386 | 1/1980 | Olsson | 339/17 F |

FOREIGN PATENT DOCUMENTS

| | | | |
|---|---|---|---|
| 2214253 | 1/1973 | Fed. Rep. of Germany | 339/176 MP |
| 2802800 | 7/1978 | Fed. Rep. of Germany | 339/176 MP |
| 1170256 | 11/1969 | United Kingdom | 339/176 MP |

*Primary Examiner*—John McQuade
*Assistant Examiner*—Gary F. Paumen
*Attorney, Agent, or Firm*—Frederick W. Raring

[57] ABSTRACT

Multi-contact connector for a flat conductor cable comprises a housing having a cable receiving face and a trough-like cable receiving opening extending into the cable receiving face. A plurality of contact terminals are mounted in the opening in side-by-side relationship. Each terminal has a spring contact portion which engages one of the conductors of the cable when the cable is inserted. The contact portions are arranged in three rows, the first row comprising the contact portion of every third terminal and which is adjacent to the cable receiving face. The second row and the third row are also formed from every third terminal and the contact portions in these rows are located at increasing distances from the cable receiving face. When the cable is inserted, its leading edge encounters the contact portions of the terminals in the first row and upon further movement into the opening, encounters the contact portions of the terminals in the second and third rows. This arrangement facilitates insertion of the flexible cable into the opening and reduces the tendency of the cable to buckle.

9 Claims, 10 Drawing Figures

2
3
4
40
40'
40"
38
18
24
2
20
28
36
16
4
8
6
2
3
4
14

24
58
18
20
22
38
40
62
60
64
8
51
34
26
16
14
12
10

58
18
32
22
40'
30
62
60
8
51
34
16
26
14
12
10

58
18
32
22
40"
64
62
8
34
26
16

CONNECTOR FOR FLAT CABLE

FIELD OF THE INVENTION

This invention relates to multi-contact connectors of the type which receive the end portion of a flat conductor cable and which has contact terminals that engage the conductors in the cable upon insertion.

BACKGROUND OF THE INVENTION

A widely used type of conductor cable comprises a film of suitable insulating plastic, such as polyethylene terephthalate having flat ribbon-like conductors thereon in side-by-side relationship. The conductors are contained in the cable among most of its length, but the insulation is stripped from an end portion of the cable on one surface to expose the conductors when it is necessary to connect the cable conductors to further conductors.

Several types of electrical connectors are available for flat conductor cables as shown, for example, in U.S. Pat. Nos. 4,181,386, 3,629,787, and 3,989,336. All of these patents show connectors for connecting flat cable conductors to conductors on a circuit board or the like. U.S. Pat. No. 4,181,386 shows a relatively simple clip of suitable resilient metal, such as spring steel, which is mounted on the circuit board in straddling relationship to the circuit board conductors so that the cable can be inserted between the contact springs of the spring clip and the surface of the circuit board whereby the cable conductors will be pressed against the circuit board conductors. The connector shown in U.S. Pat. No. 4,181,386 is of the zero insertion force type in that the contact springs can be disengaged from the surface of the circuit board to permit insertion of the cable under zero insertion force conditions.

U.S. Pat. Nos. 3,629,787 and 3,989,336 both show connectors comprising plastic housings which contain individual contact terminals. When the cable is inserted into the housing, the spring portions of the contact terminals engage the cable and press the cable conductors either against circuit board conductors, as in U.S. Pat. No. 3,629,787, or against contact portions of the terminals in the connector housing as in U.S. Pat. No. 3,989,336. U.S. Pat. No. 3,629,787 is not of the zero insertion force type and when the cable is inserted, the leading edge of the cable must transmit the forces required to deflect the contact springs so that the cable can enter the connector. Since the cable itself is extremely flexible, it is sometimes difficult to insert the cable because of its tendency to buckle under a relatively low compressive load. U.S. Pat. No. 3,989,336 overcomes this buckling problem by providing a separate clamping member on the connector housing which is normally in engagement with the contact springs and which imposes an external force on the contact springs of the terminals. When the cable is to be inserted, the clamping member is moved away from the terminals so that they no longer are capable of exerting contact forces and the cable can then be inserted under zero insertion force conditions or very low insertion force conditions. After insertion, the clamping member is moved to its operative position in which it presses the contact springs of the terminals against the cable conductors.

The connector shown in U.S. Pat. No. 3,989,336 overcomes the problem of inserting the highly flexible cable into the connector but it requires a relatively complex housing having a separate clamping means integral therewith. Furthermore, if this separate clamping means should become disengaged or inoperative while the connector is in service, the contact forces would be reduced and contact might be lost with the conductors in the cable.

The present invention is directed to the achievement of a multi-contact electrical connector for flat flexible cable which has the advantage of requiring a relatively low level insertion force when the cable is inserted, but it does not require a separate force applying means on the connector housing or any of the other features which are usually associated with zero insertion force connectors, that is features which permit the contact terminals to be displaced away from their normal zones or positions to permit insertion of the cable.

A connector in accordance with the invention comprises a relatively simple insulating housing of molded thermoplastic having a cable receiving face and having a trough-like cable receiving opening extending into the cable receiving face. A plurality of electrical contact terminals are mounted in the opening in side-by-side spaced-apart relationship at locations such that upon insertion of the cable into the opening, each of the terminals will engage one of the conductors on the cable. The contact terminals each have a spring means having a contact portion so that when the cable is inserted, the spring means is deflected by the leading edge of the cable and when insertion is complete, the contact portion will be resiliently held against the conductor on the cable by the spring means. The contact portions of the terminals in the connector housing are arranged in a plurality of rows, for example, the first row comprising the contact portions of every third terminal in the housing, is located adjacent to the cable receiving face so that when the cable is inserted, the leading edge of the cable will first encounter the spring means of this first row of terminals. The second row of contact portions is made up also of every third terminal and this row is located inwardly from the first row and a third row, when provided, is located inwardly from the second row. The leading edge of the cable thus encounters the contact portions of the terminals sequentially, rather than encountering all of the contact portions simultaneously. As a result, the insertion force required to fully insert the cable is initially relatively low, since the cable encounters only a third of the total number of terminals in the housing. Upon further insertion, the cable encounters the second row of terminals and the insertion force must therefore be increased, however, at this stage the contact terminals in the first row will be holding portions of the cable and will thereby discourage buckling of the cable. When the cable encounters the third row of terminals, the insertion force must be further increased to overcome the contact spring means of the third row of terminals but at this stage, the cable will be clamped by the contact portions by the terminals in the first row and the second row. Overall, the operation of inserting the cable into the housing is greatly facilitated and the technician is thereby encouraged to insert the cable properly into the connector housing to ensure effective contact with all of the conductors in the cable.

PREFERRED EMBODIMENT

Figure 1:
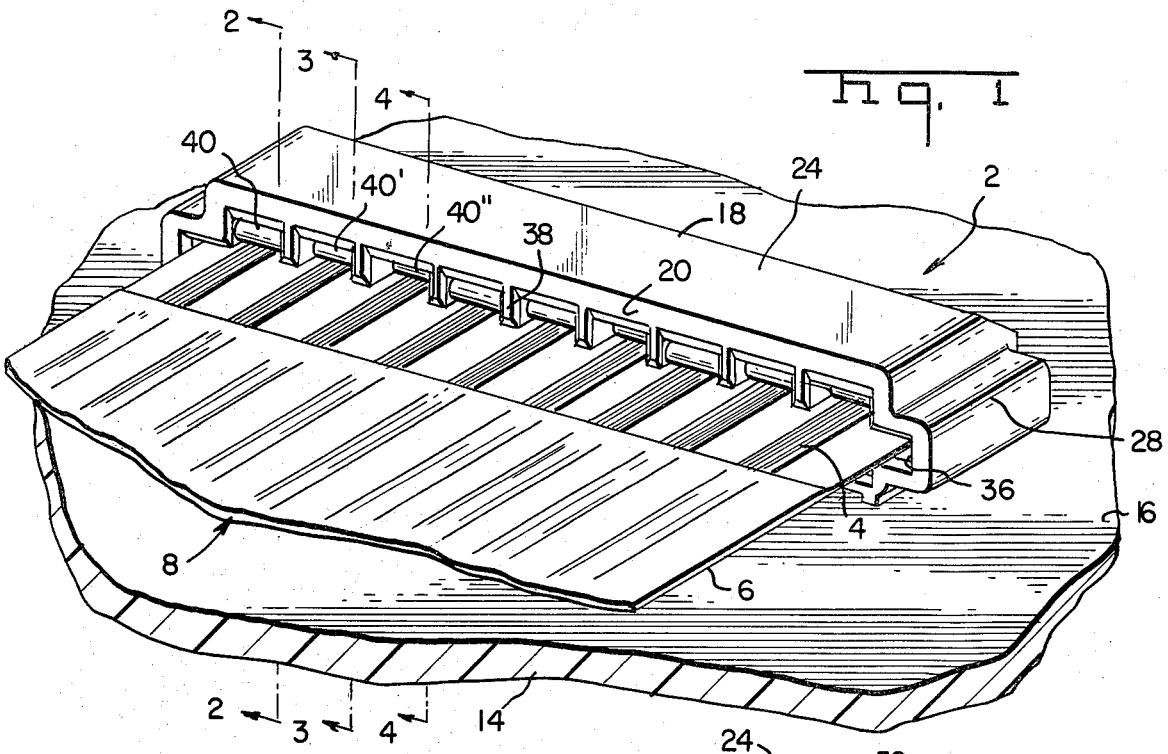
FIG. 1 is a perspective view of a connector in accordance with the invention mounted on a circuit board.

A connector 2 in accordance with the invention serves to connect conductors 4 on the upper surface 6 of a flexible cable 8 to conductors 10 on the underside 12 of a circuit board 14. As shown in the drawing, the insulation has been stripped from the upper surface of the cable at its end to expose the conductors 4. The connector 2 is mounted on the upper surface 16 of the circuit board which is provided with openings as shown for the terminal tabs of the terminals in the connector.

The connector comprises an insulating housing 18 having a cable receiving face 20, a rearward face 22, upper and lower sidewalls 24, 26 and external endwalls 28. A trough-like cable receiving opening 30 extending into the face 20 and has upper and lower opening sidewalls 32, 34 and opening endwalls 36. A plurality of spaced-apart barrier walls 38 are provided in the opening which extend transversely across the opening, and which divide the opening into a plurality of side-by-side terminal receiving cavities. A contact terminal of one of the types shown at 40, 40′ and 40″ is mounted in each of the cavities. These three types of terminals are substantially similar and differ only in certain dimensions, as will be described below.

Figure 5:
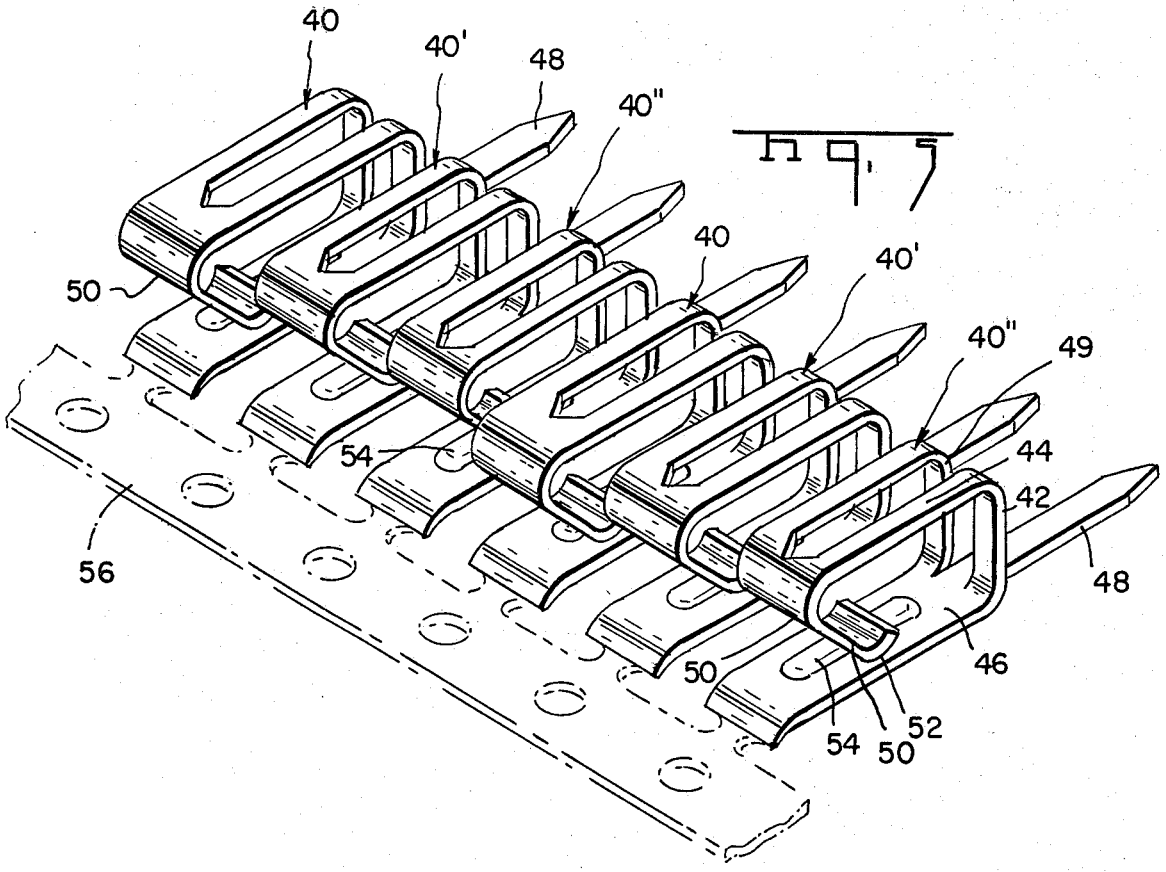
FIG. 5 is a perspective view of a portion of a strip of contact terminals.

Each terminal is generally channel-shaped and has a web 42 and parallel sidewalls 44, 46 extending forwardly as viewed in FIG. 5 from the web. The solder tab or post 48 is formed from the upper sidewall 44 and from the web 42 so that an opening as shown at 49 is provided in the upper sidewall and the web.

The upper sidewall is reversely formed at its outer end to provide a spring arm 50 which extends obliquely towards the surface of the lower sidewall 46. The end portion of the spring arm 50 is reversely formed at 52 so that its external surface serves as a contact surface which resiliently bears against an elongated boss 54 formed in the lower sidewall 46.

Figure 2:
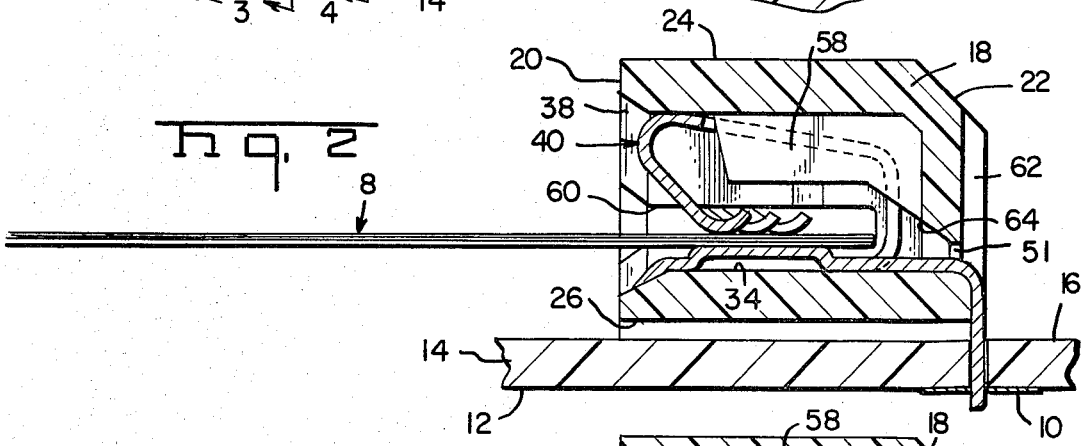
FIGS. 2, 3 and 4 are views taken along the lines 2—2, 3—3 and 4—4 of FIG. 1.
Figure 3:
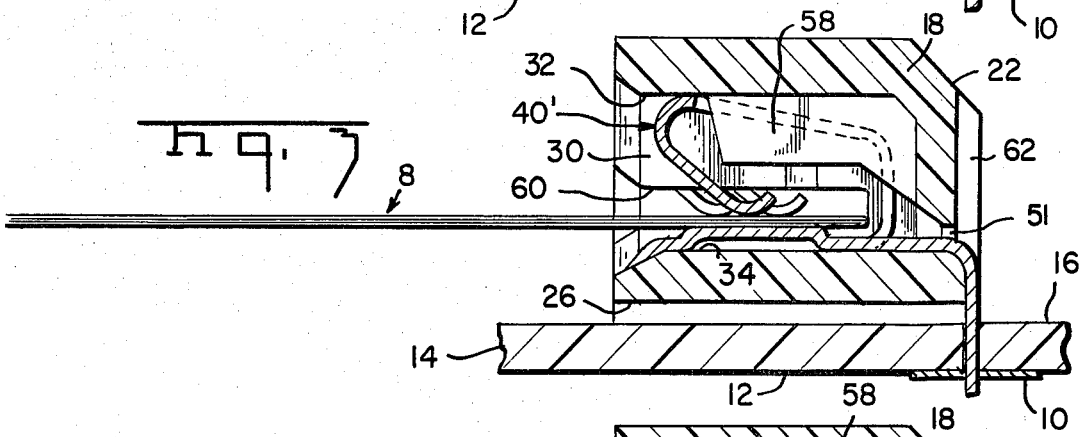
Figure 4:
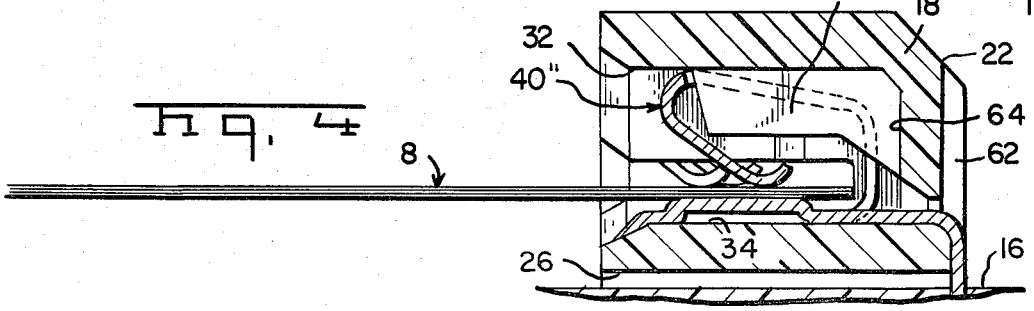

As clearly shown in FIGS. 2–4, each of the terminals 40 has a contact portion which is proximate, as compared with the contact portions of the other terminals, to the cable receiving face 20. The contact portions of the terminals 40′ are located inwardly in the opening from the contact portions of the terminals 40, while the contact portions of the terminals 40″ are located still further inwardly from the cable receiving face 20. The contact portions of the terminals 40 thus form a first row, as shown at 68 in FIG. 6, while the contact portions of the terminals 40′ and 40″ form second and third rows as shown at 70 and 72 respectively.

The terminals are manufactured as a continuous strip, as shown in FIG. 5, and the stamping die is constructed such that every third terminal has the dimensions of the terminals 40 in FIG. 5, the terminals adjacent to terminal 40 have the dimensions of terminals 40′ and the remaining terminals have the dimensions of the terminals 40″. The terminals of the strip are integral with a continuous carrier strip 56 which is severed from the terminals of the strip when the terminals are assembled to the housing. Assembly is carried out by merely moving the required number of terminals into the opening 30 until they are properly located in their respective cavities. The solder tab portions 48 will then project through opening 51 in the back wall 64 of each cavity and ribs 58 in each cavity will project into opening 49 of the terminals, as shown in FIGS. 2–4. The solder tabs can then be bent downwardly so that they will extend normally with respect to the sidewall 26. Spaced-apart slots on panels 62 are provided in the face 22 for the solder tabs. The connector is assembled to the circuit board by simply inserting the solder tabs through the openings in the circuit board and soldering the lower ends of the tabs to the conductors 10 on the underside of the circuit board.

Figure 6:
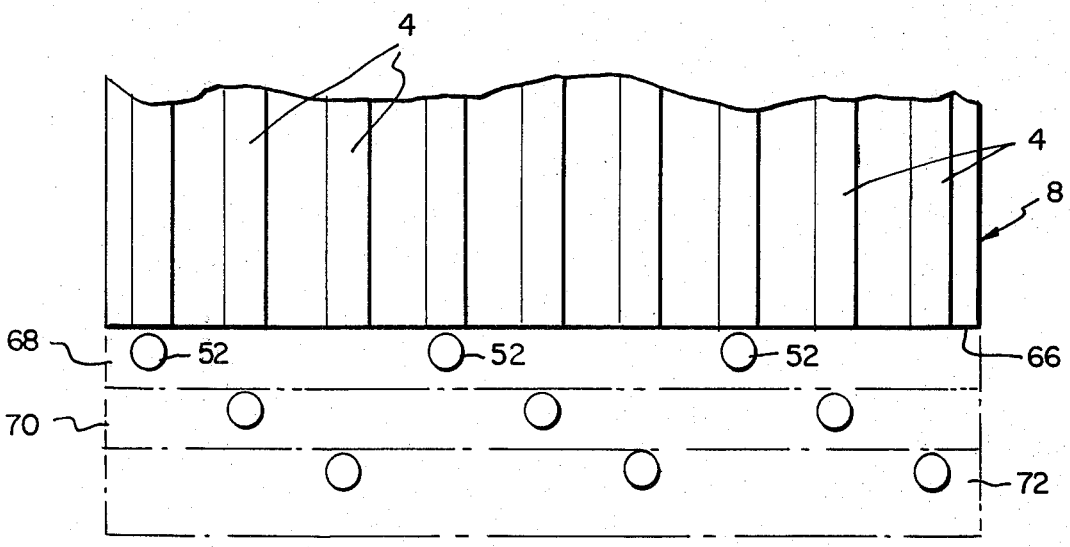
FIG. 6 is a semi-diagrammatic view illustrating the conditions which are obtained when a cable is inserted into a connector in accordance with the invention.
Figure 10:
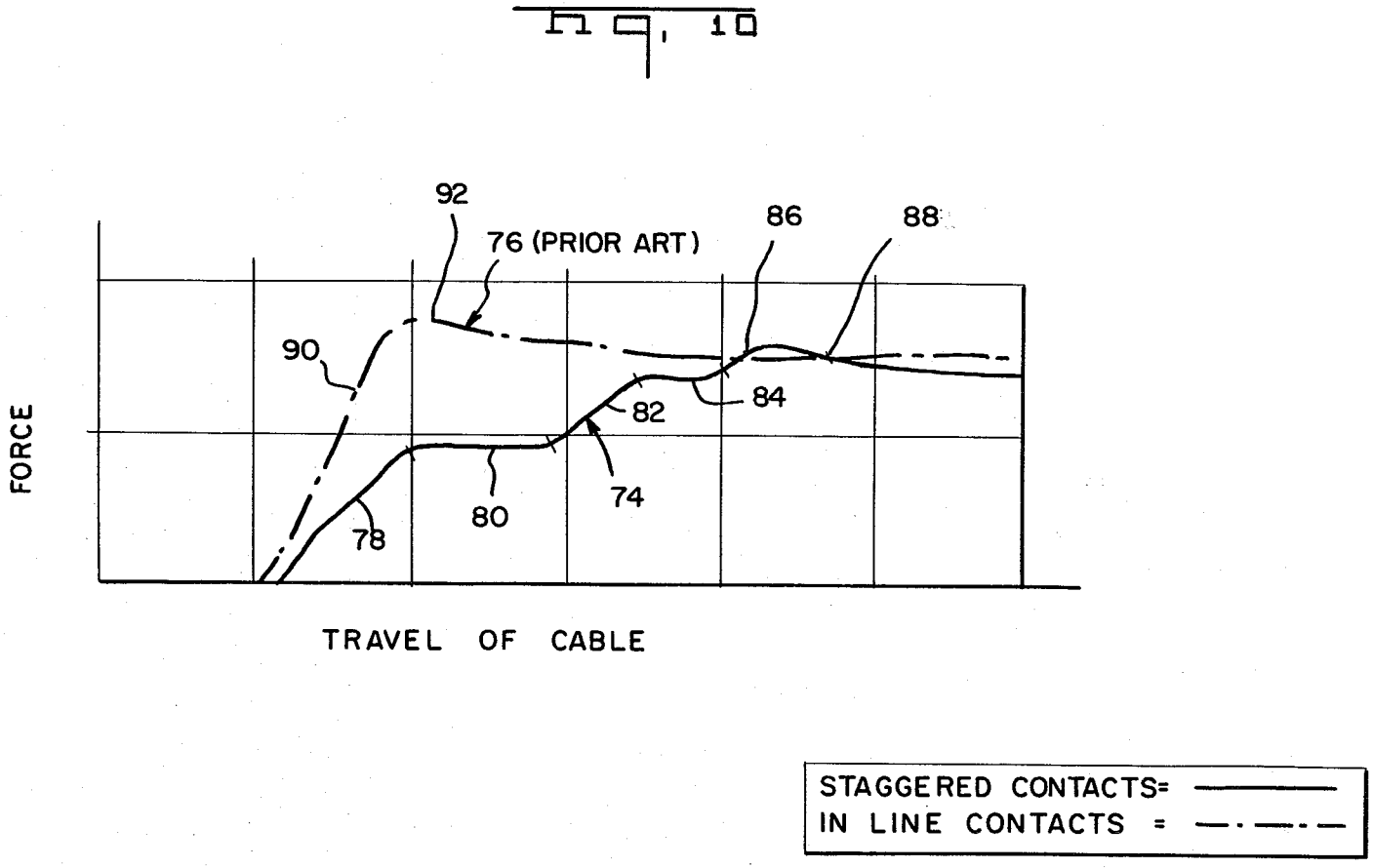
FIG. 10 shows a set of curves which illustrate the insertion forces required for inserting cable into a connector in accordance with the invention, and into a typical prior art connector.

FIGS. 6 and 10 demonstrate the advantages achieved with connectors in accordance with the invention when the cable 8 is inserted into the connector. During insertion, the leading end 66 of the cable first encounters the contact portions 52 of the terminals 40 which are disposed in the row 68 which is proximate to the cable receiving face 20. At this time, the cable must be pushed with sufficient force to overcome the spring arms 50 of the terminals 40 and deflect the spring arms so that the cable can pass beneath the contact portions 52. Since only one third of the total number of terminals in the housing are encountered, the acquired force is not excessively high. Upon further insertion of the cable, the leading edge 66 encounters the contact portions of the terminals 40′ in row 70 and the insertion force must thereby be increased to overcome the spring arms of these terminals. However, at this stage, the cable will be clamped by the contact portions 52 of the terminals 40 in the first row 68 and this clamping of portions of the cable discourages buckling in the vicinity of the terminals in the second row 70. Similarly, when the cable encounters the contact portions of the terminals 40″, the insertion force must be further increased, but at this stage, the cable will be clamped by the contact portions of the terminals in the first row 68 and in the second row 70 so that buckling of the leading edge of the terminal will again be discouraged. The technician must increase the thrust he imparts to the cable but he can do this by simply gripping the terminal very close to the face 20 while he pushes the cable into the connector.

FIG. 10 shows at 76 the conditions which are encountered when a cable is inserted into a conventional connector having all of the terminals in alignment with each other so that the contact portions of all of these terminals are encountered by the cable at the same time. The insertion force required rises abruptly to a maximum level, as shown at 90, and the technician must push the cable with a force sufficient to overcome the contact springs of all of the connectors. After the cable has past the contact portions of the terminals, the force to push the cable a further distance levels off and may fall slightly at 92. The operation of pushing the cable past the contact portions of the terminals is sometimes difficult and requires a technique which is not always apparent when assembly operations are being carried out by unskilled technicians.

The curve 74 demonstrates that by the practice of the invention only a relatively low insertion force is required at 78 and 80 to push the cable past the first row of terminals. The insertion force must be increased as shown at 82 and 84, to push the cable past the second row of terminals and a further increase is required as shown at 86 and 88, to push the cable past the third row of terminals. While the actual amount of work required to insert the cable is probably about the same for the prior art connector as it is for the present connector, the insertion operation proceeds much more smoothly when the contact terminals have staggered contact portions in accordance with the invention.

Figure 7:
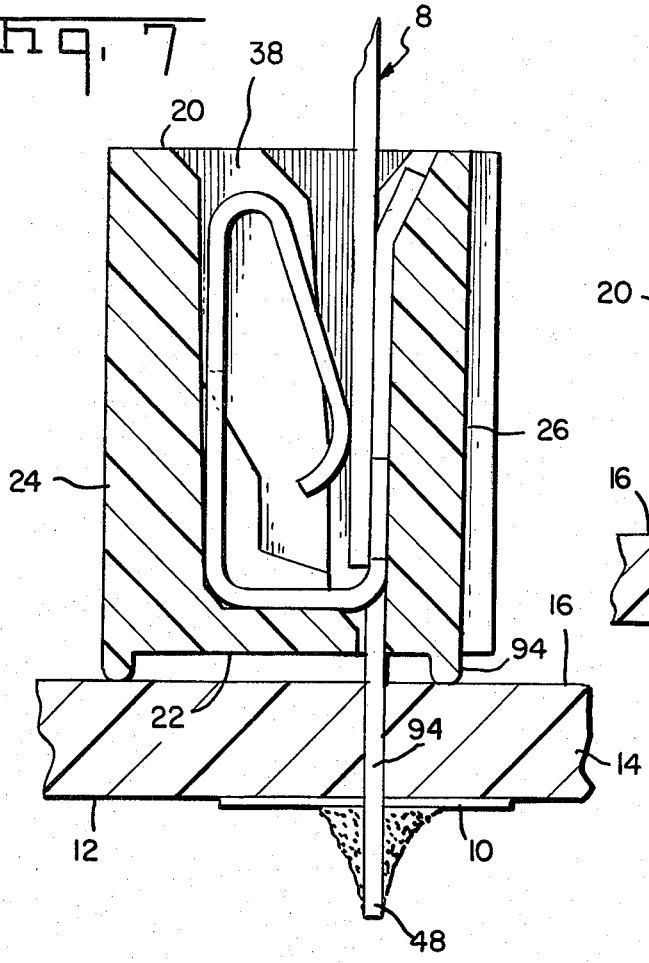
FIG. 7 is a sectional view of a connector mounted in an alternative orientation.

FIG. 7 shows a modified connector in accordance with the invention, which is intended to be mounted on the surface 16 of the circuit board with the rearward face 22 of the connector against the circuit board. The housing in this embodiment has standoff members 96 which elevate the face 22 above the surface 16 to permit cleaning of the board after the soldering operation has been carried out. The solder tab 94, in this embodiment, extends normally from the face 22 and directly into the opening in the circuit board.

Figure 8:
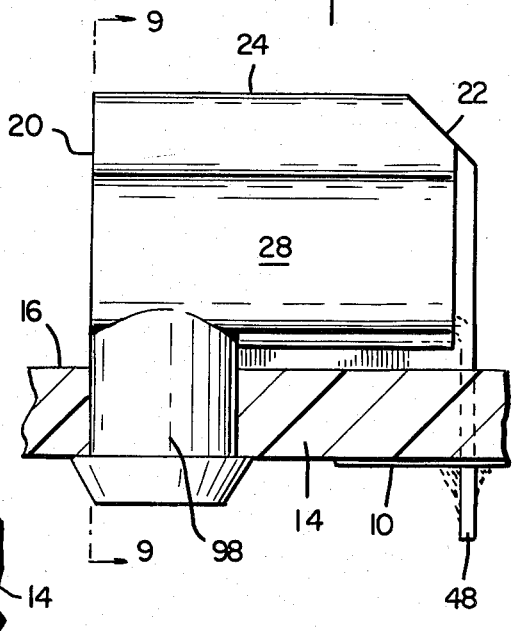
FIG. 8 is a side view of a connector of the type shown in FIG. 1 having a housing latching means integral therewith.
Figure 9:
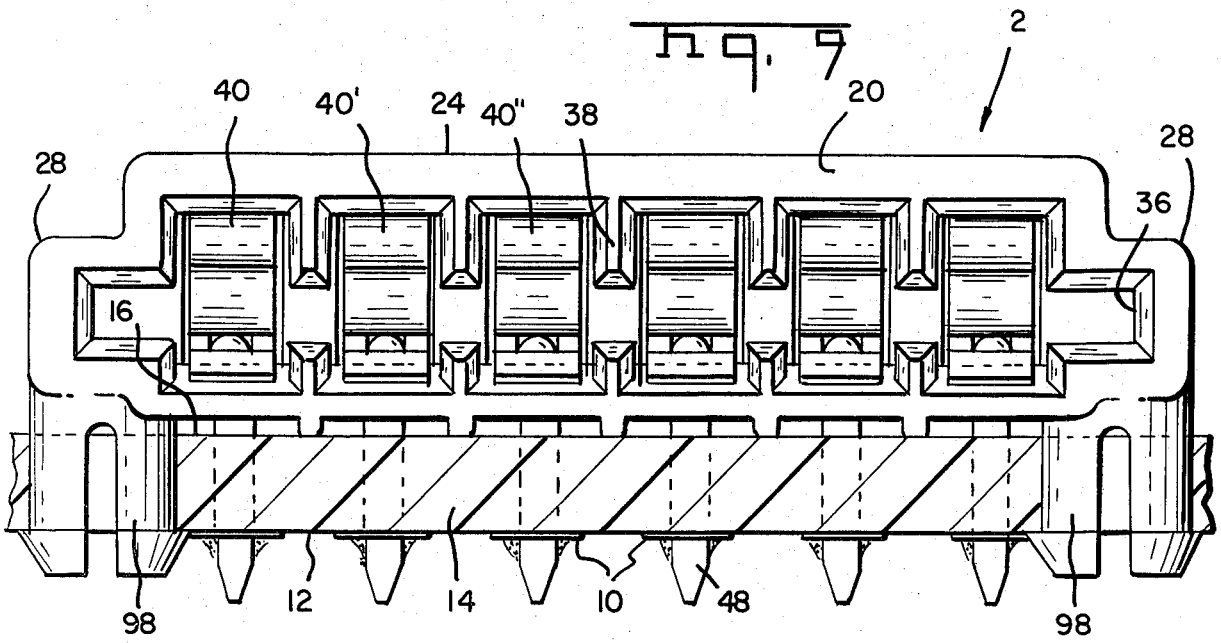
FIG. 9 is a view looking in the direction of the arrows 9—9 of FIG. 8.

FIGS. 8 and 9 show an embodiment similar to the embodiment of FIG. 1 but having separate latching members 98 adjacent to the face 20 of the housing. The provision of these latching member is desirable if the connector is destined for abusive handling for the reaon that in the embodiment of FIG. 1, the mechanical connection of the housing to the circuit board is by means of solder tabs 48 and the soldered connections to the conductors 10. Careless handling of the circuit boards or the connectors could result in damage to the soldered connections in some circumstances, and the latching members 98 will avoid this problem.

As an alternative to the latching members 98, an apron or lip can be provided on one or both of the faces 20, 22 of the housing adjacent to the lower sidewall 26. The aprons would be located such that they would bear against the surface 16 of the circuit board 14 and thereby prevent rocking of the housing with respect to the circuit board thereby preventing damage to the solder connections.

The principles of the invention can be used with a variety of types of connectors having types of contact terminals other than those shown. The terminals illustrated herein are of the general type disclosed in U.S. Pat. No. 4,060,296.

Terminals of this type are preferable to some other types for the reason that the contact portion 52 of each terminal bears against the lower arm 46. The cable is therefore clamped between two portions of the terminal and contact will be made with the conductors of the cable regardless of which side of the cable is against the ends of the spring arms 50.

We claim:

1. A multi-contact electrical connector which is intended to receive and establish electrical contact with, terminal areas on a flat flexible cable means which has at least two electrically separate terminal areas thereon, said connector being of the type comprising an insulating housing having a cable receiving face and having a trough-like cable receiving opening extending into said cable receiving face, first and second contact terminals in said opening, said terminals being in side-by-side spaced-apart relationship and being electrically separate from each other, each of said terminals having a contact spring means which is deflected by said cable means when said cable means is inserted into said opening, each of said spring means having a contact portion which is against, and in electrical contact with, one of said terminal areas when said cable means is fully inserted into said opening, said connector being characterized in that:

said contact portion of said first contact spring means is relatively proximate to said cable receiving face and is spaced inwardly from said cable receiving face by a predetermined distance, said contact portion of said second contact spring means is spaced inwardly from said cable receiving face by a distance which is greater than said predetermined distance whereby, during insertion of said cable means into said opening, said cable means first encounters and deflects said first contact spring means and upon further movement of said cable means into said opening, said cable means encounters and deflects said second contact spring means.

2. A multi-contact electrical connector as set forth in claim 1, said connector having a third contact terminal in said opening, said third contact terminal having a contact spring means having a contact portion, said contact portion of said third contact terminal being spaced inwardly from said cable receiving face by a distance which is greater than the distance between said cable receiving face and said contact portion of said second contact terminal.

3. A multi-contact electrical connector as set forth in claim 1, said connector having a plurality of first contact terminals therein and a plurality of second contact terminals, said first contact terminals being arranged in a first row and said second contact terminals being arranged in a second row, each of said second contact terminals being separated by one of said first contact terminals.

4. A multi-contact electrical connector as set forth in claim 3, said housing of said connector having a plurality of third contact terminals therein, said third contact terminals being arranged in a third row which extends parallel to said first and second rows, said contact portions of said third contact terminals being spaced inwardly from said cable receiving face by a distance which is greater than the distance between said cable receiving face and said contact portions of said second contact terminals, adjacent third contact terminals in said third row being separated by one first contact terminal and one second contact terminal in said first and second rows.

5. A multi-contact electrical connector which is intended to receive, and establish electrical contact with, the electrically separate spaced-apart terminal areas on one surface of a flat flexible conductor cable, said connector being of the type comprising an insulating housing having a cable receiving face and having a trough-like cable receiving opening extending into said cable receiving face, a plurality of electrically separate contact terminals in said opening, each of said terminals having a contact spring means which is deflected by said cable when said cable is inserted into said opening, said spring means being against, and in electrical contact with, said terminal areas when said cable is fully inserted into said opening, said connector being characterized in that:

said contact terminals are arranged in at least two rows, said rows extending parallel to said cable receiving face, the first one of said rows being proximate to said cable receiving face, the second one of said rows being spaced from said face, adjacent terminals of said first row being separated by at least one terminal of said second row whereby, during insertion of said cable into said opening, said cable first encounters said terminals in said first row and deflects said spring means of said terminals in said first row, and thereafter said cable encounters and deflects said spring means of said terminals in said second row, and insertion of said cable into said opening is thereby facilitated.

6. A multi-contact electrical connector as set forth in claim 5, said connector having a third row of contact terminals therein, said third row being located inwardly of said second row.

7. A multi-contact electrical connector as set forth in claim 6, each of said spring means comprising a spring arm.

8. A multi-contact electrical connector as set forth in claim 7, said opening having opposed sidewalls and having endwalls, said rows extending parallel to said sidewalls and between said endwalls, each of said terminals having a generally channel-shaped portion having a web and terminal sidewalls, said terminal sidewalls being substantially against said sidewalls of said opening, said spring arm of each terminal extending from one of said terminal sidewalls towards the other terminal sidewall whereby both surfaces of an inserted cable are against said terminals.

9. A multi-contact electrical connector as set forth in claim 8, each of said terminals having a solder post portion extending therefrom, said solder post portions extending externally of said housing and being intended for soldering to a circuit board conductor on a printed circuit board.

* * * * *